United States Patent [19]

Yamamoto

[11] Patent Number: 4,502,613

[45] Date of Patent: Mar. 5, 1985

[54] EXTRUDER FOR CONTENTS IN TUBE CONTAINERS

[76] Inventor: Ken Yamamoto, 22-5 4 chome, Nishisakado, Saitama Ken, Japan

[21] Appl. No.: 437,024

[22] Filed: Oct. 27, 1982

[51] Int. Cl.[3] ..... B65D 35/28

[52] U.S. Cl. ..... 222/103; 251/9

[58] Field of Search ..... 222/103; 251/9, 10

[56] References Cited

U.S. PATENT DOCUMENTS

| | | | |
|---|---|---|---|
| 422,906 | 3/1890 | Booth | 251/10 |
| 3,961,727 | 6/1976 | Spears | 222/103 |
| 4,159,787 | 7/1979 | Wright | 222/103 |
| 4,365,727 | 12/1982 | Shmelkin | 222/103 X |

*Primary Examiner*—Joseph J. Rolla
*Assistant Examiner*—Frederick R. Handren
*Attorney, Agent, or Firm*—Donald D. Mon; David O'Reilly

[57] ABSTRACT

An extruding device for dispensing the contents of a tube container by compressing the container between bottom and top members. The top member is hingedly connected to the bottom member at one end and closes over and latches at the other end. The bottom and top members form a pair of in-line openings along opposite sides for receiving a tube container. A pivotally mounted locking lever is provided in the top member and may be pressed down against the bottom member to lock the tube container in the extruding device.

6 Claims, 4 Drawing Figures

EXTRUDER FOR CONTENTS IN TUBE CONTAINERS

FIELD OF THE INVENTION

This invention relates to an extruder for contents contained in tube container, such as toothpaste, glue, paint, cosmetics, adhesives, medicine, etc.

BACKGROUND OF THE INVENTION

Heretofore, contents contained in a tube container have been extruded by pressing the bottom of the tube container between the fingers after removing the cap. In the case of aluminum tube containers, the tube is often folded after each decrease in its contents. However, the fold produces a crease at the empty part of the tube and makes it not only difficult to fold, but some of the contents remain at the crease and are wasted. A plastic tube container may be easier to fold but it is also necessary to be sure to squeeze the whole length of the tube because the plastic tends to expand and draw the contents back into the tube again. Therefore, efficient use and complete evacuation of the contents is difficult.

BRIEF DESCRIPTION OF THE INVENTION

The object of the invention is to provide an extruder for a tube container which permits easy and efficient dispensing of tube contents.

DETAILED DESCRIPTION OF THE INVENTION

Figure 1:
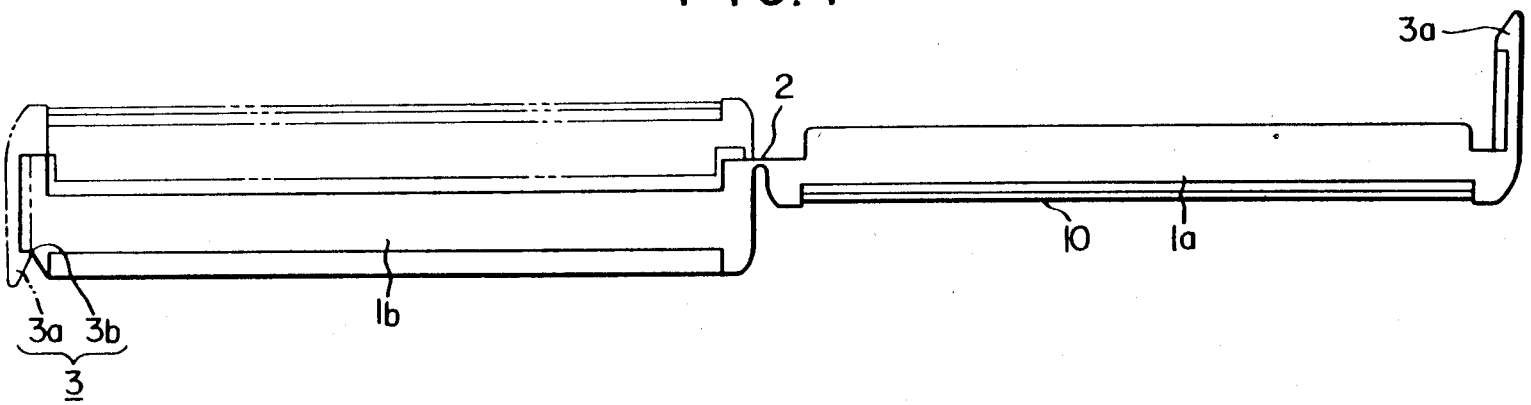
FIG. 1 is a front view of an enlarged scale of an extruder according to an embodiment of this invention.

As shown in FIG. 1, extruder press members 1*a,* 1*b* are connected at their ends by a self-hinge 2, and at their other ends by a latch engaging means 3. For example, catch 3*a* is provided at the other end of extruding member 1*a* and recess 3*b* is provided at the other end of extruding member 1*b* as the latch engaging means. The specific construction of the latch engaging means 3 is not limited to the construction shown in the drawings.

Figure 3A:
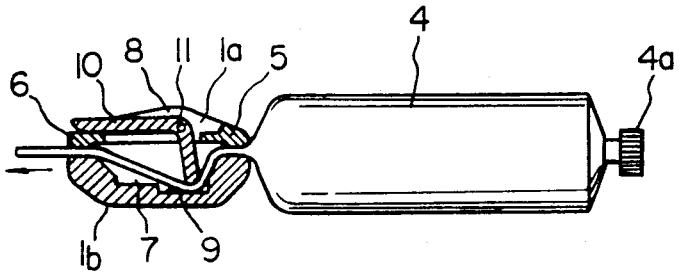
FIGS. 3*a, b,* are cross-sectional views at line 3—3 of FIG. 2 illustrating the operation of the extruder of FIG. 1.

Between extruder press members 1*a,* 1*b,* there are two longitudinal openings 5,6 and a path provided by cavity 7 in communication with the openings 5,6 for receiving the end of a tube container 4 which lies in the cavity between openings 5,6. Extruder press member 1*a* has an opening 8 to receive a pivotable lever 10. Lever 10 is angular and L-shaped in cross-section as shown in FIGS. 3*a,* 3*b* and is pivotally attached to the end walls of opening 8 of extruder press member 1*a* by shaft 11 passing through the apex of the bend in the L-shaped lever 10.

Figure 3B:
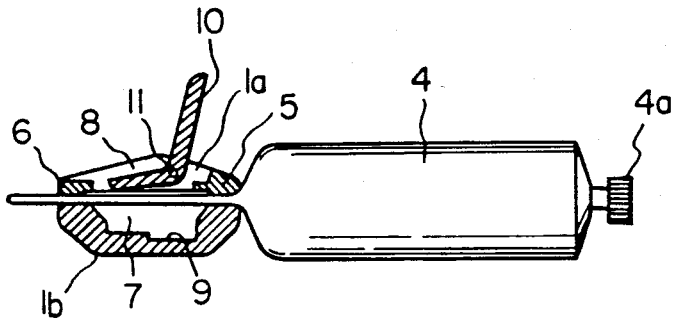

The cap 4*a* of a full container is removed and the bottom end of the tube container 4 is pressed between the fingers or is positioned between extruder press members 1*a,* 1*b*. Press members 1*a,* 1*b* are closed against one another until catch 3*a* is engaged in recess 3*b*. The end of tube container 4 is compressed by the front edge of press member 1*a,* forcing the contents out through the cap end. As the tube container 4 progresses through the extruding device, it is successively compressed between lever 10 and bottom 9 of extruder press member 1*b* as shown in FIG. 3*a*. In this position the tube container 4 is tightly held between extruder press members 1*a* and 1*b*. To dispense additional contents from the tube when in the position shown in FIG. 3, the bottom end of tube container 4 is drawn to the left in the direction shown by the arrow in FIG. 3*a*. This causes lever 10 to release by rotating it in a clockwise direction about shaft 11 to the position shown in FIG. 3*b,* in turn causing tube container 4 to be squeezed between opening 5,6 dispensing its contents. Lever 10 may then be again rotated in a counterclockwise direction about shaft 11 back to the position shown in FIG. 3*a,* to lock tube container 4 in the extruding device.

Figure 2:
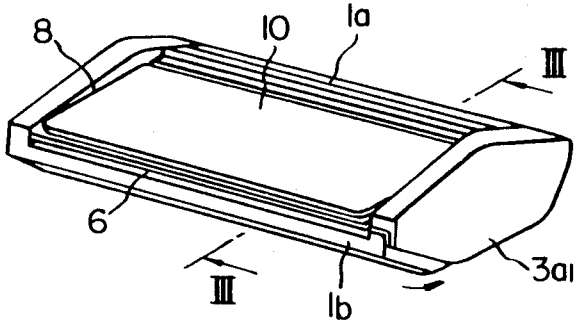
FIG. 2 is a perspective view of the extruder of FIG. 1 in its closed condition.

For disengaging extruder members 1*a,* 1*b* from an empty tube, the end flange having the catch 3*a* is bent outward in the direction indicated by the arrow in FIG. 2.

As described above, the contents contained in a tube container may be dispensed easily, accurately and efficiently with the extruding device of the invention.

This invention is not to be limited by the embodiment shown in the drawings and described in the description, which is given by way of example and not of limitation, but only in accordance with the scope of the appended claims.

I claim:

1. An extruder for dispensing contents from a tubular container comprising; a pair of extruding members connected at one end by a hinge; engagement means at the other end of said extruding members constructed to engage and close said extruding members; said extruding members being constructed to form a pair of openings on opposite sides and extending between said ends; said extruding members when closed constructed to provide a path between said pair of openings; one of said extruding members having an opening above said path for receiving a lever means having an L-shaped cross-section; said lever being pivotally mounted in end walls of said one extruding member at opposite ends of said opening above said path; said lever means constructed to press down on a tubular container positioned in said path between said pair of openings thereby locking the position of the tubular container.

2. The device according to claim 1 including means for releasing said lever means so that said tubular container may be drawn through said pair of openings.

3. A device according to claim 2 in which said lever means is pivotally mounted by a shaft passing through the apex of said L-shaped cross-section whereby one flange of said L-shaped lever presses down on the side of a tube positioned in the extruding device when a force is applied to the other flange of said L-shaped lever.

4. The device according to claim 3 in which said means for releasing said lever means comprises; means mounting said lever means so that a force applied to said one flange by a tubular container drawn through said pair of openings releases said lever means.

5. A device according to claim 1 in which said engagement means comprises a catch at the end of one of said extruding members; and a recess in the end of the other of said extruding members constructed and arranged to receive said catch to hold said pair of extruding members closed against one another with said tubular container compressed there between.

6. A device according to claim 5 in which said path through said pair of extruding members comprises a cavity in the other of said extruding members in alignment with the opening in said one extruding member.

* * * * *